United States Patent [19]

Schroeder

[11] 3,954,596

[45] *May 4, 1976

[54] PRODUCTION OF LOW SULFUR HEAVY OIL FROM COAL

[76] Inventor: Wilburn C. Schroeder, 7316 Radcliffe Drive, College Park, Md. 20740

[ * ] Notice: The portion of the term of this patent subsequent to Dec. 16, 1992, has been disclaimed.

[22] Filed: June 3, 1974

[21] Appl. No.: 476,105

[52] U.S. Cl. ..... 208/10; 208/8

[51] Int. Cl.[2] ..... C10G 1/06

[58] Field of Search ..... 208/8, 10; 48/197 R

[56] References Cited

UNITED STATES PATENTS

| | | | |
|---|---|---|---|
| 2,654,661 | 10/1953 | Gorin | 48/197 R |
| 2,756,194 | 7/1956 | Mayland | 208/10 |
| 2,840,462 | 6/1958 | Gorin | 208/8 |
| 3,075,912 | 1/1963 | Eastman et al. | 208/8 |
| 3,527,691 | 9/1970 | Hodgson | 208/10 |
| 3,551,124 | 12/1970 | Iwaki et al. | 48/197 R |
| 3,663,420 | 5/1972 | Jacobs et al. | 208/8 |
| 3,729,407 | 4/1973 | Camp et al. | 208/10 |
| 3,755,137 | 8/1973 | Schuman | 208/10 |
| 3,840,456 | 10/1974 | Yavorsky et al. | 208/8 |

*Primary Examiner*—Delbert E. Gantz
*Assistant Examiner*—James W. Hellwege
*Attorney, Agent, or Firm*—Bacon & Thomas

[57] ABSTRACT

A low sulfur content, heavy oil is produced from coal by direct hydrogenation at a temperature of about 820° to 1000°F and pressure of about 500 to 4000 psi in a pressurized closed cyclic system through which hydrogen is circulated. Coal, oxygen and steam are fed into the pressurized system and the heavy oil of low sulfur content is removed as the product. The pressurized system includes a gas reforming zone, in which hydrocarbon gases produced in the system are reformed with steam and oxygen to provide all or part of the hydrogen requirements of the process, and a coal hydrogenation zone which receives hydrogen-containing gases from the gas reforming zone along with pulverized coal from a pressure feeder. The product oil is separated from the oil and gas effluent of the hydrogenation zone and the resulting gases which contain most of the sulfur from the coal along with a controlled amount of gaseous hydrocarbons are then purified to remove sulfur and are recycled to the reforming zone to produce the hydrogen requirement without substantial reduction in system pressure. If desired, part of the hydrogen requirement may be supplied by feeding coal to the reforming zone along with the recycle gases.

14 Claims, 1 Drawing Figure

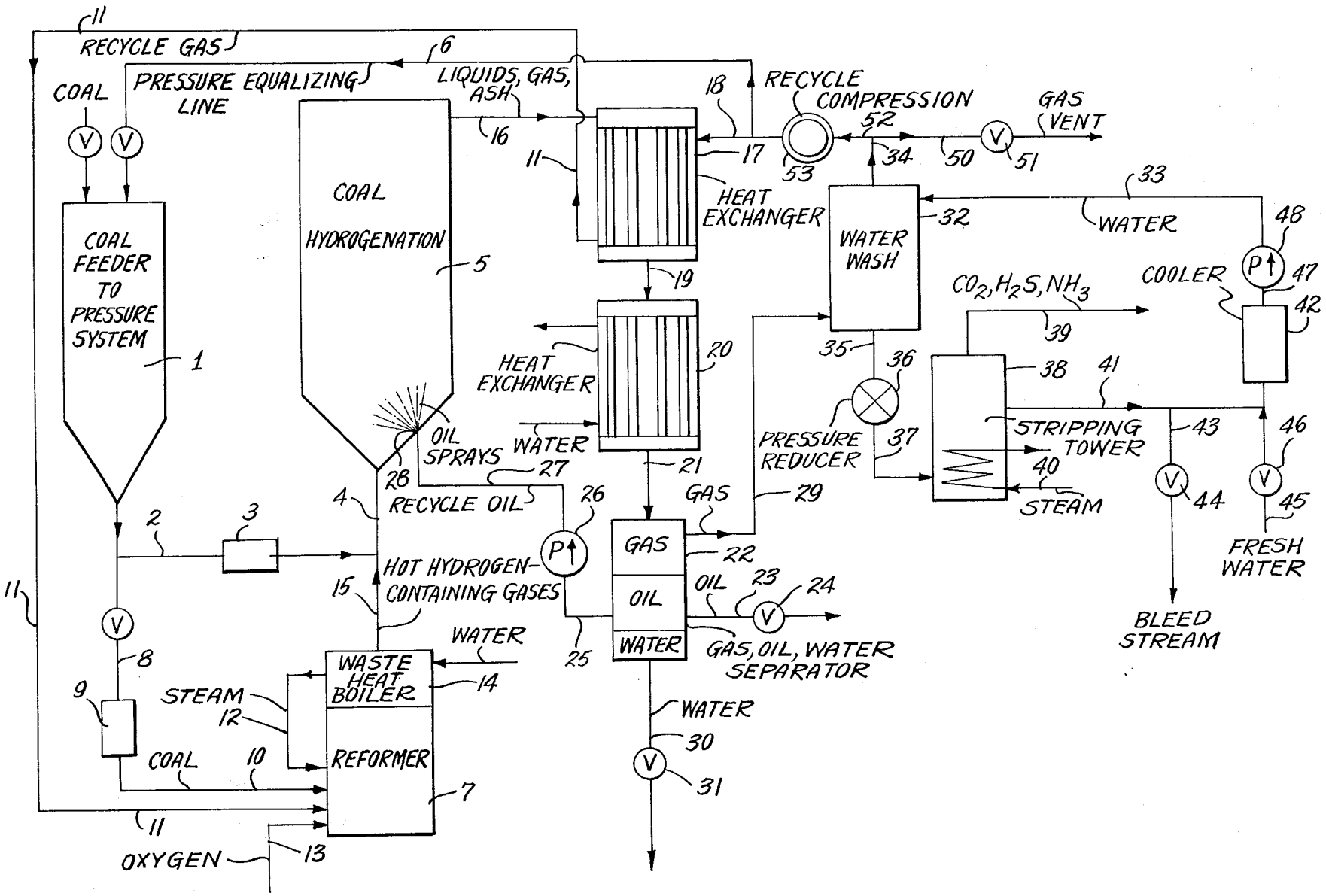
COAL FEEDER TO PRESSURE SYSTEM
COAL
RECYCLE GAS
PRESSURE EQUALIZING LINE
COAL HYDROGENATION
LIQUIDS, GAS, ASH
OIL SPRAYS
RECYCLE OIL
HEAT EXCHANGER
HEAT EXCHANGER
WATER
HOT HYDROGEN-CONTAINING GASES
WATER
WASTE HEAT BOILER
REFORMER
STEAM
COAL
OXYGEN
GAS
OIL
WATER
GAS, OIL, WATER SEPARATOR
WATER
RECYCLE COMPRESSION
HEAT EXCHANGER
WATER WASH
PRESSURE REDUCER
$CO_2, H_2S, NH_3$
STRIPPING TOWER
STEAM
COOLER
WATER
GAS VENT
FRESH WATER
BLEED STREAM

PRODUCTION OF LOW SULFUR HEAVY OIL FROM COAL

COPENDING APPLICATIONS

This application is related to my copending applications Ser. no. 268,201, filed June 30, 1972, now U.S. Pat. No. 3,823,084, Ser. No. 412,026, filed Nov. 1, 1973 and Ser. No. 456,163, filed Mar. 29, 1974.

BACKGROUND

My prior U.S. Pat. Nos. 3,030,297, issued Apr. 17, 1962 and U.S. Pat. 3,152,063, issued Oct. 6, 1963 disclose coal hydrogenation processes and set forth the general conditions of temperature, pressure and time under which coal can be hydrogenated to produce oil and gas. In the processes of these patents, reactions between coal and hydrogen were carried out in the presence or absence of catalysts. At higher temperatures, catalysts were found to have relatively small effect. The products from these processes were generally light liquid hydrocarbons and gaseous hydrocarbons which were mixed with the hydrogen used to hydrogenate the coal. My U.S Pat. No. 3,762,773, issued Oct. 2, 1973, discloses a method and apparatus for feeding finely divided solids such as coal, to a pressurized gas or gas-liquid-solid system without loss of gas pressure from the pressurized system.

The process of the present invention recognizes the need for a low sulfur, heavy oil which can be economically produced from naturally-occurring, solid carbonaceous materials, such as the large bituminous coal deposits which exist in the United States and other portions of the Western World. The present invention modifies my prior coal hydrogenation processes in such way as to meet this low recognized need.

SUMMARY OF THE INVENTION

The invention comprises the direct conversion of coal into low sulfur, heavy oil by reacting hydrogen with the chemical consituents of the coal at a temperature in the range of about 820° to 1000°F and a pressure in the range of about 500 to 4000 psi in a hydrogenation zone of a closed, cyclic, high pressure system through which a relatively large volume of hydrogen is circulated and in which the hydrogen for the coal conversion is produced in a reforming zone from gaseous hydrocarbon by-products of the hydrogenation reaction. The only raw materials fed to the system are coal, oxygen and water (in the form of steam) all of which are introduced under system pressure. Most of the sulfur of the coal is contained in the gaseous effluent from the hydrogenation zone and is removed without substantial reduction in system pressure prior to recirculation of the gases through the reforming zone of the system.

The coal is converted into low sulfur, heavy oil in a highly efficient manner. The facilities for the coal hydrogenation plant as well as its capital cost are greatly reduced in comparison to a plant for the hydrogenation of coal to light oils. The amount of hydrogen required per ton of coal is small, which reduces the operating cost substantially. The hydrogen requirements can be provided by adjusting the conditions in the hydrogenation zone to make just that amount of gaseous hydrocarbon necessary for production of the hydrogen requirement in the reforming zone.

The heavy oil product is especially useful for commercial boilers such as those used in utility and large industrial plants. The low sulfur content is desirable from the standpoint of ecology considerations and laws. The process allows coal to be converted to heavy oil at locations adjacent to existing or new utility or industrial plants so that the oil product need not be transported long distances. Preferably, the oil will still be hot from the process when received at the boilers. Of course, the oil product may be transported longer distances by conventional means and may be used for other purposes including processing to provide lighter hydrocarbon products.

By the present process it is possible to obtain a coal conversion rate of 80% or more, based on the heating value of the oil produced divided by the heating value of the coal consumed, including that used for power for the process.

DETAILED DESCRIPTION

The word "coal," as employed herein, includes lignites, subbituminous and bituminous coal and similar solid carbonaceous material. It is preferably crushed to a size range such that most of it will pass through a 100 mesh screen. However, it will be understood that this is not a critical feature of the invention.

The crushed or pulverized coal is fed into the hydrogenation zone of the closed cyclic system under system pressure by means of pressurized feeders, preferably such as disclosed in my aforesaid U.S. Pat. No. 3,762,773, using recycled hydrogen-containing gases from the system as the pressurizing gas.

Hydrogen for the hydrogenation step is generated within the closed system at system pressure by feeding hydrocarbon-containing recycle gas (optionally with some coal), oxygen and steam, all at system pressure to a suitable reforming unit, thereby eliminating the need for a mechanical compression step to compress the hydrogen. Heat for the hydrogenation reaction is also supplied by the gases generated in the reformer. Heavy oil, which is the primary product of this invention, is cooled in heat exchangers and is removed from the closed cyclic system as a liquid product.

Cooled effluent gases after removal of the liquid oil product and which are still at system pressure are washed with water or other suitable liquid to remove $H_2S$, $NH_3$ and $CO_2$. The remaining gases are primarily hydrogen mixed with methane and higher hydrocarbons. These are recycled to the reformer for the hydrogen make and then through the system. It is desirable to maintain a relatively large volume of recycle hydrogen in the system to provide the necessary equilibrium conditions for the hydrogenation reaction and to act as a carrier for the coal. Hydrogen circulation through the reactor will vary from two to three times to about ten times the amount of hydrogen used.

In the process the hydrogenation of the coal is carried out under conditions providing a high yield of low sulfur, heavy oil. These conditions are less severe than those required for the hydrogenation of coal to lighter oils. Generally, the temperature will be in the range of about 820° to 1000°F and the pressure in the range of about 500 to 4000 psi, depending upon the catalyst employed and the residence time selected. Conventional coal hydrogenation catalysts are used with catalysts of the iron type being preferred. The preferred temperatures are from about 830° to 925°F and the preferred pressures are from about 1000 to 2000 psi.

The necessity to feed coal to the reforming zone may be eliminated by controlling the reaction conditions in the hydrogenation zone so that methane and/or higher hydrocarbon gas production is sufficient to supply the total fuel and hydrogen requirements for the process.

DESCRIPTION OF THE INVENTION IN CONJUNCTION WITH THE DRAWING

This invention is illustrated by the accompanying drawing, wherein the FIGURE represents a flow diagram of a coal hydrogenation system embodying the principles of the invention.

Referring to the FIGURE, solid, pulverized coal from a pressurized feeder vessel 1 is fed through line 2, and flow controller 3 into line 4 which supplies hydrogenator 5 with hot hydrogen-containing gases. Recycled hydrogen, methane and higher hydrocarbon gases which have not been preheated are used to pressurize the coal feeder 1 through line 6 as shown. The coal feed system may be made continuous through the use of a plurality of feeders in a manner well known in the art.

Hydrogen in sufficient quantity to supply the hydrogen requirements for the process is produced in reformer 7 and coal hydrogenator 5. One means of producing the hydrogen in reformer 7 is as follows: Coal from the pressurized feeding unit 1 flows through line 8 to a flow controller 9, at any selected rate, including zero, and then through line 10 to the reformer 7, which is operated at the pressure of the closed cyclic system. Hot hydrogen and hydrocarbon-containing recycle gases from the process enter the reformer 7 through line 11. The pressure in the closed system, as aforesaid, is generally within the range of from about 500 to 4000 psi, with the pressure in the gas recycle lines 6 and 11 being slightly higher than that in the reformer and hydrogenation units in order to ensure flow through the system. Steam at the required pressure is generated from waste heat from the reformation and gasification operation in the reformer 7 and is fed to the reformer through line 12. Oxygen, generated at system pressure in an air separation plant (not shown), is fed to the reformer 7 through line 13. It is desirable to preheat this oxygen, e.g., to about 1000°F, before it is fed to the reformer. This is one means by which temperature in the reformer can be adjusted.

The reformer 7 is preferably an internally insulated, refractory lined, water jacketed, steel vessel suitable for use at temperatures up to about 3000°F and pressures required in the cyclic system. Reactions in the reformer between hydrocarbon-containing recycle gases (and optionally coal), oxygen and steam generate largely hydrogen and carbon monoxide, along with a small amount of carbon dioxide. More particularly, the reactions taking place in the reformer are between hydrocarbon gases (and carbon) with oxygen to furnish heat and between these gases and water to produce hydrogen. The reactions are well known in the art and need no explanation here.

It is desirable to run the reformer at high temperatures since this increases the speed of the reactions and especially the rates of steam decomposition. It also reduces the amount of carbon dioxide in the gas. In general, the minimum desirable temperature is about 1800°F and the maximum about 3000°F. Where coal is supplied to the reformer, the maximum temperature should be below the fusion point of the ash produced. It is not necessary to remove the ash from the gases produced in this unit.

Primary control of the gasification temperature in the reformer 7 is by the amount of oxygen and steam admitted, with more oxygen increasing the temperature, and more steam decreasing the temperature. Secondary control is by the degree of preheat of these reactants. The steam is always supplied in substantial excess of the stoichiometric requirements and the oxygen in insufficient amount to cause excessive production of $CO_2$ and $H_2O$.

The hot gases from the reformer 7 pass through waste heat boiler 14 to generate steam. The steam generated in the water cooled jacket of the reformer and in the waste heat boiler 14 may be used to supply the steam requirement of the reformer.

The hot gases leaving the waste heat boiler 14, which will generally be at a temperature of 1400°F or higher, depending on the heat requirement of hydrogenator 5, leave through line 15 and mix in line 4 with coal entering from line 2. The hot gases and coal then enter hydrogenator 5. Alternatively, instead of having the coal entrained in the gas stream as it passes through the reactor, it may be separately supplied to and maintained in the hydrogenator as a fluidized bed.

The hydrogenation reaction is conducted in the presence of a catalyst. Thus, a hydrogenation catalyst may be introduced with the coal or may be present in reactor 5 in the form of a fixed or ebullating bed. Such catalysts, are well known to the art, and include cobalt-molybdate and iron-containing materials.

Iron-containing materials are particularly suitable catalysts for the hydrogenation of coal in the present process. These may be present as steel or iron turnings in the hydrogenation vessel. An additional effect is obtained from the presence of iron in that this is a suitable catalyst for converting any CO in the incoming hydrogen stream to $CO_2$ and additional hydrogen by reaction with water vapor in accordance with the well known shift conversion reaction, as follows:

$$CO + H_2O \rightarrow H_2 + CO_2 .$$

The temperature of the hydrogenator for production of heavy oils is in the region where this reaction proceeds rapidly and the equilibrium is strongly towards the production of hydrogen and carbon dioxide. The presence of the iron catalyst prevents the buildup of appreciable concentrations of carbon monoxide in the recycle gas. The carbon dioxide resulting from this reaction is removed from the recycle stream in subsequent purification steps.

The hydrogenation of the coal to form oils is generally slightly exothermic. Hydrogenation of coal to methane is fairly strongly exothermic. In general, however, the gases coming through line 4 must be several hundred degrees F higher in temperature than the temperature in reactor 5. One skilled in the art will have no difficulty in making the proper adjustments in the proportions and preheat temperatures of the reactants supplied to reformer 7 to meet these conditions.

During the reactions of coal and hydrogen in reactor 5 to form oils and hydrocarbon gases, other compounds such as $H_2S$ and $NH_3$, are also formed. Neither $H_2S$ nor $NH_3$ interferes with the coal hydrogenation reactions even if the reactions are carried out in the presence of a catalyst, since hydrogenation catalysts are normally resistant to poisoning by these compounds.

Major factors controlling the distribution between oil and gas formation in the coal hydrogenation reactions in reactor 5 are temperature, pressure and retention time. Temperatures suitable for the present process are from about 820° to 1000°F, preferably from about 830° to 925°F. At temperatures from 820° to 1000°F coal particles suspended in hydrogen hydrogenate very rapidly and the amount of liquid formed may be above 80 percent of the coal hydrogenated, with the remainder being gaseous hydrocarbons. Pressures required for the hydrogenation are in the range from about 500 to about 4000 psi, preferably from 1000 to 2000 psi.

Retention time in the hydrogenation reactor will depend on the temperature, pressure and type of coal used. Generally, it will be in the range of about 10 seconds to a few minutes, with lower temperatures and pressures requiring longer times. Bituminous coal will require more time than subbituminous or lignite.

The amount of hydrogen required in the hydrogenator 5 to hydrogenate the coal to heavy oil will vary in the range from about 4000 scf to 15,000 scf per ton, depending on the rank and the amount of sulfur, nitrogen and oxygen in the coal as well as the desired fluidity of the product oil. The volume of hydrogen circulated through the hydrogenator 5 is desirably from 2 or 3 times to about 10 times the amount of hydrogen used. The velocities of the gas in the hydrogenator will depend on the method used to hydrogenate the coal. When a fluidized bed is used, suitable gas velocities are in the range from about 0.05 to 0.5 feet per second. If the coal is to be entrained in the gas stream, then gas velocites of from about 2 to 10 or more feet per second depending on the size of the coal particles are required.

Effluent gases, liquids, and ash leave hydrogenator 5 and pass through line 16 to heat exchanger 17 where they are cooled by recycle gas coming in through line 18. The cooled effluent materials leave heat exchanger 17 through line 19 and are further cooled in heat exchanger 20 in indirect contact with water or other cooling fluid. The cooled liquids, gas and ash flow then through line 21 to gas, oil and water separator 22.

The product oil is taken off at this point through line 23 and valve 24. It contains a few percent of light oils in the distillable range but is mainly heavy oils and tars. It also contains the ash from the coal. The sulfur content of the oil is below 0.5 percent, since the sulfur in the coal has been largely converted to $H_2S$ and is now in the gas stream. It is low in nitrogen for about half the nitrogen in the coal is converted to $NH_3$, which is also in the gas stream. The product is quite desirable as a fuel for modern commercial boiler systems.

The oil from separator 22 is under system pressure and should be maintained at a high enough temperature so that it will flow readily through lines and valves to the boiler where it is to be used. Since the oil contains the ash from the coal the boiler furnace should be equipped with ash-handling facilities as well as ash removal facilities for the stack gases. In existing large-scale boilers utilizing coal these facilities normally exist and they may be provided for new boilers.

Of course, the oil from the process may be stored for utilization to meet peak loads or to supply fuel if the coal hydrogenation plant is not operating. However, such oil is preferably kept hot in order to make it pumpable.

The oil product from the process may also be filtered or centrifuged while it is hot and under pressure to remove a major portion of the ash.

The oil product is an aromatic material which is mainly a complex of rings of 6 carbon atoms and is a good solvent or dispersant for coal. The processes of this invention, therefore, also can be operated to produce mixtures of heavy oil which contain coal in dissolved, dispersed or suspended state. This is accomplished by feeding coal at a high ratio to the hydrogen gas cycling through the system. The resulting product which is a mixture of heavy oil and coal is a satisfactory fuel for commercial type boilers which are equipped with suitable pumps and burners. It should be noted, however, that the hydrogenation step must be sufficiently complete to reduce the sulfur to the desired level to meet pollution requirements.

It is desirable with some subbituminous and lignitic coals to recycle about 5 to 10 percent of the oil product back to the hydrogenator since this improves the catalytic action between the solid catalyst, the hydrogen, and the coal at the time the coal first enters the reactor. As shown in the FIGURE, this is accomplished by withdrawing oil from the separator 22 through line 25 and forcing it by means of pump 26 through line 27 and sprays 28 which are inside reactor 5.

It has been noted that the product oil taken off through line 23 and valve 24 contains a few percent of light oils. These light oils may include gasoline and naphtha. In certain instances it may be desired to remove them. One method of doing this is to distill the light ends from the product heavy oil. The same purpose may be accomplished without a separate distillation step if the products from the hydrogenator 5 are cooled in heat exchangers 17 and 20, only sufficiently to condense the heavy oil but leave the light ends in a vaporized state. The light ends will then be carried out of the gas-oil-water separator 22 with the gas stream which leaves through line 29. A heat exchanger or cooler (not shown) may then be provided in line 29 to further cool the gas stream to condense the light oils, which can be recovered as liquid materials.

Water accumulated in separator 22 which comes from the condensation of the steam in the effluent gases is discharged from the separator through line 30 and pressure reducing valve 31.

The gas separated from the oil in separator 22 is primarily a mixture of hydrogen and hydrocarbon gases with minor amounts of impurities comprising $CO_2$, $H_2S$ and $NH_3$. It flows through line 29 to water wash vessel 32. Wash water enters the top of vessel 32 through line 33 and under the pressure of the system readily absorbs the impurities of the gas. The purified gases, which are largely hydrogen, methane and higher hydrocarbon gases, leave through line 34.

The wash solution, containing $CO_2$, $H_2S$, and $NH_3$, leaves through line 35. The pressure on the rich wash solution is reduced in pressure reduction device 36 and the solution flows through line 37 into stripping tower 38. At low pressure, e.g., atmospheric, $H_2S$ and $CO_2$ separate from the solution and leave through line 39. Heat is also applied to the solution to remove $NH_3$. Heat is provided by steam entering through line 40 into the heating coil of the stripping tower. The $NH_3$ also leaves through line 39. The $CO_2$, $H_2S$ and $NH_3$ leaving through line 39 may be treated to recover ammonia, and to convert $H_2S$ to liquid or solid sulfur by well known techniques, e.g., the Claus process. The $CO_2$ may be vented.

The wash solution leaves tower 38 through line 41 and is introduced into cooler 42. Bleed line 43 and valve 44 are provided to bleed part of the solution from the system to prevent the accumulation of excessively high concentrations of undesirable materials. Also, if desired, fresh water may be admitted through line 45 and valve 46.

The cooled recycled solution from cooler 42 leaves through line 47, is brought back to systems pressure in pump 48, and then recycled through line 33 to water wash vessel 32.

If necessary to prevent the accumulation of excess gas in the recycle system, gas may be vented from recycle line 34 through line 50 and valve 51. The vented gas will have a heating value in excess of 400–500 Btu per scf and can be used for combustion purposes. Recycle gas from line 34 is supplied by line 52 to recycle compressor 53 which restores the pressure drop that has occurred during the passage of the gas through the system. This is usually no more than about 100 psi. It is preferable to compress the recycle gas to a pressure slightly above the system pressure so as to ensure flow of materials through the closed cycle of operations but since the gas is already at high pressure relatively little energy is consumed. Line 18 carries the recycle gas to heat exchanger 17 where it is heated by the outgoing gases and liquids from hydrogenation. The gas is then returned through line 11 to reformer 7 and then to coal hydrogenator 5 for completion of of the cycle. Line 6, which is a pressure equalizing line, carries the gas directly from line 18 to the coal feeder 1 without passage through the heat exchanger.

In the above discussion of the process, it has been disclosed that coal may be added to the reformer 7. However, the coal hydrogenation system is advantageously operated so that it is unnecessary to feed coal at this point. Such operation requires that the methane production (or higher hydrocarbon gases) be sufficient to supply the total fuel and hydrogen requirements for the process. This is not a substantial burden on the process, since the hydrogen requirements to produce heavy oil from coal are not great. Significantly, by not feeding coal to the reformer the oxygen and steam requirements of the process are decreased. Furthermore, temperature limitations in the reformer caused by the presence of ash in the coal are also eliminated.

The amount of methane and other hydrocarbon gases formed is controlled by the conditions existing in the coal hydrogenation reactor 5. Higher temperatures in the reactor increase methane formation quite rapidly at fixed conditions of pressure and retention time. Both higher temperatures and higher pressure have a still stronger effect. For a given coal it is possible to select conditions that will provide about the amount of methane needed to balance the process. These conditions may be readily determined by one skilled in the art. For example, a coal requiring 6000 scf of hydrogen per ton for conversion to heavy oil would need about 2500–3000 scf of gas (calculated as methane) going to the reformer. This corresponds to conversion of about 100 lbs of coal to methane out of a ton of coal or about 5 percent.

Gas leaving reformer 7 is mostly hydrogen containing small amounts of CO, $CO_2$, $CH_4$ and steam. It should be noted that the CO and steam introduced by the reformer are greatly diluted by the large amounts of hydrogen being recycled through the process. Also, the major portion of the CO produced in the reformer reacts with steam to produce hydrogen and $CO_2$ by the water gas shift reaction as the gas is cooled to hydrogenation temperatures. This is facilitated where an iron containing catalyst is used in the hydrogenation. The small amounts of CO, $CO_2$ and residual methane do not interfere with the coal hydrogenation reactions.

The hydrogen requirement of the process may be calculated as follows: Coal normally contains hydrogen in amounts ranging from about 4 to 6 percent on a maf basis. Heavy oil to be produced from the hydrogenation process will contain about 8 to 11 percent hydrogen. Hydrogen is also needed to convert the sulfur in the coal to $H_2S$ and the nitrogen to $NH_3$. Part of the oxygen in the coal is converted to $H_2O$ and part to $CO_2$. Therefore, to convert this coal in the process described there is needed an addition of hydrogen to the coal in amounts ranging from about 3 or 4 to 6 or 7 percent. This hydrogen is supplied primarily by hydrogen generation in the reformer as described.

EXAMPLE

The process is applied to a bituminous coal having an ultimate analysis, on a moisture and ash free basis (maf), as follows:

| Component | Weight Percent |
|---|---|
| C | 83.0 |
| $H_2$ | 6.0 |
| $O_2$ | 4.2 |
| $N_2$ | 3.5 |
| S | 3.3 |
| TOTAL | 100.0 |

The heating value of this coal on the maf basis is 15,200 Btu per lb.

Conversion of the carbon in this coal to the heavy oil product desired requires the addition of approximately 8000 scf of hydrogen per ton of coal.

The operating conditions in the coal hydrogenation reactor for this conversion are approximately as follows:

| | |
|---|---|
| Temperature | 840°F |
| Pressure | 1000 psi |
| Catalyst | Cobalt-molybdate pellets as an ebullating bed |
| Hydrogen required | 8000 scf per ton of (maf) coal |
| Gas recirculation | 32,000 scf per ton |
| Retention time | 12 seconds |
| Oxygen required | 160 lbs per ton |
| Steam required | 450 lbs per ton |

The heavy oil produced amounts to 1570 lb. per ton of maf coal with a heating value of about 17,000 Btu per lb. The overall efficiency of the process, based on the heating value of the oil produced, divided by the heating value of the total coal (including coal required for power) input, is between 80 and 90 percent.

The conditions set forth in the foregoing example are illustrative of one representative application of the process. It is to be understood that these conditions may be varied in many ways. It is not intended that the application of the various steps and conditions described be limited only to the representative example set forth.

The embodiments of the invention in which an exclusive property or privilege is claimed are defined as follows:

1. A process for hydrogenating coal to provide a low sulfur, heavy oil product, comprising introducing said coal in the substantial absence of a slurrying medium into a hydrogenation zone of a closed cyclic system having hydrogenation, purifying and oxygen-steam reforming zones, said system being maintained at a pressure in the range of about 500 to 2000 psi, hydrogenating said coal in the hydrogenation zone with hot gases containing hydrogen, carbon monoxide and steam at a temperature in the range of about 820° to 1000°F. and with a contact time of no more than a few minutes, the reaction conditions being correlated to provide an effluent stream containing excess hydrogen, heavy liquid and gaseous hydrocarbons and gaseous impurities including sulfur, removing the heavy liquid hydrocarbons from said effluent stream without substantial reduction in system pressure, removing sulfur from the resulting effluent gas stream in said purifying zone without substantial reduction in system pressure, introducing the resulting hydrogen and hydrocarbon gas stream into said reforming zone, reforming said hydrocarbons in said zone with oxygen and steam to provide said hot gases containing hydrogen, carbon monoxide, and steam and introducing the hot gases from the reforming zone into the hydrogenation zone to complete the cycle.

2. The process of claim 1 in which the volume of hydrogen circulation through the hydrogenation zone is at least 2 to 3 times the volume of the hydrogen used for hydrogenating the coal in said zone.

3. The process of claim 1 wherein coal, oxygen and steam are introduced into the reforming zone in addition to the recycle gases from the purifying zone.

4. The process of claim 1 wherein hydrogenation of the coal is carried out in the presence of a hydrogenation catalyst.

5. The process of claim 1 wherein the temperature in the hydrogenation zone is maintained in the range of about 830° to 925°F and the pressure in the system is maintained in the range of about 1000 to 2000 psi.

6. The process of claim 1 in which the hot hydrogen-containing gases produced in the reforming zone are at a temperature in excess of hydrogenation temperature to thereby provide heat for use in the hydrogenation zone.

7. The process of claim 1 wherein the stream of gases after removal of heavy liquid hydrocarbons is purified by contact with water at system pressure to remove $H_2S$ and $CO_2$ and $NH_3$ prior to recycle to the reforming zone.

8. The process of claim 1 wherein coal is added to the system through a feeder pressurized by a portion of the continuously circulating hydrogen containing gases in the closed cyclic system.

9. The process of claim 1 wherein a portion of the oil product is introduced into the hydrogenation zone with the coal.

10. The process of claim 1, wherein the amount of hydrocarbon gases produced in the hydrogenation zone is controlled to provide the hydrogen requirement of the process by reformation in the reforming zone.

11. The process of claim 1 in which the hydrogenation zone contains a metallic iron containing catalyst to facilitate the hydrogenation reaction and to convert CO and steam in the gases from the reformer to hydrogen and $CO_2$ by the shift reaction.

12. The process of claim 11 wherein the iron containing catalyst is in the form of steel or iron turnings.

13. The process of claim 1 wherein the coal is fed at a high ratio of coal to hydrogen gas so as to provide a product which is a mixture of heavy oil and coal with a sulfur content of said mixture sufficiently low to meet pollution regulations.

14. A process for hydrogenating sulfur-containing coal to provide a low sulfur, heavy oil product suitable for commercial boilers comprising: introducing said coal in the substantial absence of a slurrying medium into a hydrogenation zone of a closed cyclic system having hydrogenation, purifying and oxygen-steam reforming zones, said system being maintained at a pressure of about 1000 to 2000 psi, hydrogenating said coal in said hydrogenation zone in the presence of metallic iron or steel containing catalyst with hot gases containing hydrogen, carbon monoxide, and steam from the reforming zone at a temperature in the range of about 830° to 925°F. and with a contact time of no more than a few minutes, the reaction conditions being correlated to provide an effluent stream containing excess hydrogen, heavy liquid and gaseous hydrocarbons, and gaseous impurities including $H_2S$, $CO_2$ and $NH_3$, cooling said effluent stream to condense the heavy liquid hydrocarbons, removing said liquid hydrocarbons as a product stream without substantial reduction of system pressure, removing $H_2S$, $CO_2$ and $NH_3$ from the resulting gaseous stream in said purifying zone without substantial reduction in system pressure, introducing the resulting hydrogen and hydrocarbon gas stream into said reforming zone with or without added coal, reforming said hydrocarbons in said zone with oxygen and steam to provide at least a portion of the hydrogen requirement for hydrogenating the coal and introducing the hot gases containing hydrogen, carbon monoxide and steam from the reforming zone into the hydrogenation zone to complete the cycle.

* * * * *

UNITED STATES PATENT OFFICE

CERTIFICATE OF CORRECTION

Patent No. 3,954,596 Dated May 4, 1976

Inventor(s) WILBURN C. SCHROEDER

It is certified that error appears in the above-identified patent and that said Letters Patent are hereby corrected as shown below:

Column 1, line 13, change "1963" to --1964--.

Column 1, line 37, change "low" to --now--.

Column 1, line 42, change "consituents" to --constituents--.

Column 5, line 30, change "velocites" to --velocities--.

Signed and Sealed this

Thirteenth Day of July 1976

[SEAL]

*Attest:*

RUTH C. MASON
*Attesting Officer*

C. MARSHALL DANN
*Commissioner of Patents and Trademarks*